United States Patent [19]

Tank

[11] Patent Number: 4,679,858

[45] Date of Patent: Jul. 14, 1987

[54] MINING MACHINE CUTTER PICK INSERT

[75] Inventor: Klaus Tank, Essexwold, South Africa

[73] Assignee: DeBeers Industrial Diamond Division (Propietary), Johannesburg, South Africa

[21] Appl. No.: 696,050

[22] Filed: Jan. 29, 1985

[30] Foreign Application Priority Data

Jan. 31, 1984 [ZA] South Africa ..... 84/0716

[51] Int. Cl.[4] ..... E21C 35/18; E21B 10/46

[52] U.S. Cl. ..... 299/91; 175/410; 407/118

[58] Field of Search ..... 299/91, 92; 175/410, 175/411, 412, 413; 407/118

[56] References Cited

U.S. PATENT DOCUMENTS

| | | | |
|---|---|---|---|
| 2,101,376 | 12/1937 | Voightlander | 175/411 |
| 2,522,045 | 9/1950 | Knowles | 175/410 |
| 2,614,811 | 10/1952 | Melendy | 175/411 |
| 3,455,000 | 7/1969 | Flaherty | 407/118 |
| 3,528,465 | 9/1970 | Omley | 407/118 X |
| 3,868,750 | 3/1975 | Ellis et al. | 407/118 |
| 4,050,170 | 9/1977 | Proehl | 175/410 X |
| 4,077,734 | 3/1978 | Kita | 175/410 X |
| 4,212,559 | 7/1980 | Persson | 299/92 X |
| 4,334,585 | 6/1982 | Upton | 175/410 X |
| 4,505,342 | 3/1985 | Barr et al. | 175/410 X |
| 4,520,881 | 6/1985 | Phaal | 175/410 X |
| 4,529,048 | 7/1985 | Hall | 407/118 X |
| 4,536,037 | 8/1985 | Rink | 299/91 X |

FOREIGN PATENT DOCUMENTS

| | | | |
|---|---|---|---|
| 897192 | 4/1972 | Canada | 299/92 |
| 1219886 | 6/1966 | Fed. Rep. of Germany | 299/92 |
| 1408935 | 7/1965 | France | 299/92 |

*Primary Examiner*—Stephen J. Novosad
*Assistant Examiner*—Michael A. Goodwin
*Attorney, Agent, or Firm*—Scully, Scott, Murphy & Presser

[57] ABSTRACT

A cutting tool for a mining machine of the type used for cutting soft materials such as coal. The cutting tool has a holding lug 10 and a cylindrical pin 18 located in a socket in the holding lug and presenting a cutting edge or surface in the form of an abrasive compact 26. The pin 18 is secured in the socket by means of a non-metallic adhesive or soft solder and a body 38 located in a cavity formed by co-operating and aligned grooves 32, 34 formed in contacting surfaces of the pin and a side of the socket. The body 38 in the cavity serves to restrain the pin against rotational movement in the socket.

7 Claims, 4 Drawing Figures

MINING MACHINE CUTTER PICK INSERT

BACKGROUND OF THE INVENTION

This invention relates to mining machines of the kind which are used to cut a variety of soft materials such as coal.

In machines of this type a plurality of cutting tools (also known as elements) are positioned, for example, on the surface of a drum, in a cutting direction against the face of the material to be cut. Each tool comprises a holding lug and an insert usually secured in a socket in the lug. The cutting tip of the insert may be made of cemented carbide or abrasive compact.

The insert is usually secured to the bore of the lug by means of a braze. During brazing, it is necessary to heat the zone of the lug surrounding the bore. The lug is normally made of a hardened steel and this heating causes the hardened steel in this zone and elsewhere to soften. Thus, brazing does have the disadvantage that it introduces a weakness into the cutting tool.

SUMMARY OF THE INVENTION

According to the present invention, there is provided a cutting tool for a mining machine comprising a holding lug and a cylindrical pin located in a socket in the holding lug and presenting a cutting edge or surface for the tool, the pin being secured in the socket by means of a non-metallic adhesive or soft solder and means being provided to restrain the pin against rotational movement in the socket.

DETAILED DESCRIPTION OF THE INVENTION

Figure 1:
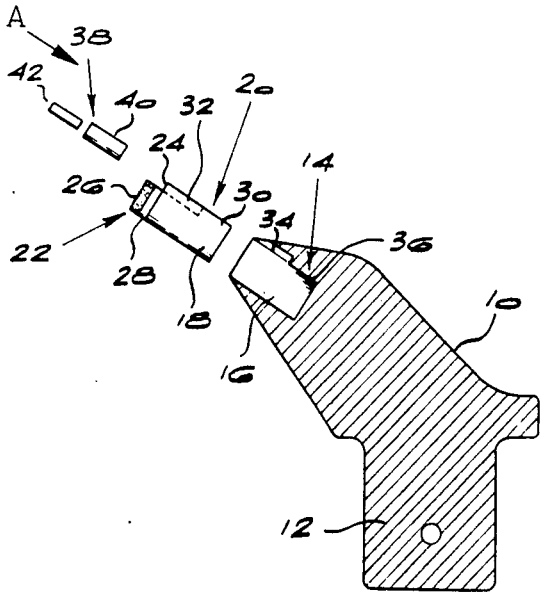
FIG. 1 illustrates a sectional, exploded side view of a cutting tool of the invention.

It has been found that the combination of the use of a non-metallic adhesive or soft solder and the restraining means results in the pin being firmly secured in the socket. Dislodgement from the socket and rotation in the socket during use are both effectively prevented. Moreover, since neither the non-metallic adhesive nor the soft solder require the use of high temperatures, damage to the pin, its cutting edge or surface and to the holding lug during manufacture is effectively prevented. Soft solders, as is known in the art, have low melting points. Examples of suitable soft solders are copper-based or lead-based alloys having a melting point in the range 200° C. to 400° C. Examples of suitable copper-based alloys are those sold by Degussa under the tradenames Soldamoll 220, Soldamoll 230, Soldamoll 235, Soldamoll 280 and Soldamoll 340. Where the pin is made of a material such as cemented carbide which is not readily wetted by such solders it is preferable to provide the pin with a thin metallic coating which will bond readily to the solder. An example of such a coating is a nickel coating.

The non-metallic adhesive is preferably an anaerobic adhesive such as that sold under the tradename Loctite. Such adhesives are single-component polyester-type resins which self-harden into tough structural solids when confined between close-fitting metal or like parts. Examples of other suitable adhesives are two-part adhesives such as epoxy resisns, and adhesives sold under the tradenames Bostik and Araldite.

The restraining means preferably comprises a body located in a cavity created by co-operating and aligned grooves formed in contacting surfaces of the body and a side of the socket. The body may be a spring pin, cylindrical pin, cotter pin or the like of any suitable cross-section. Alternatively, the body may comprise a sleeve adapted to receive a pin, insertion of which in the sleeve causes the sleeve to bear firmly against the sides of the cavity. The grooves may be formed down the length of the pin or transverse to it.

The invention has particular application to cutting tools wherein the pin has secured to one end thereof an abrasive compact or composite abrasive compact which presents an abrasive compact cutting edge or surface for the tool. The abrasive compact or composite abrasive compact is generally brazed to the cylindrical pin. Any brazing of the pin in the socket of the holding lug tends to weaken the braze between the compact or composite compact and the pin. The use of the non-metallic adhesive or soft solder and restraining means obviates this disadvantage.

The abrasive compacts and composite abrasive compacts for the inserts of such cutting tools are well known in the art and are fully described in the patent literature. Examples of patents describing compacts and composite compacts are U.S. Pat. Nos. 3,141,746; 3,745,623; 3,743,489 and British Pat. No. 1,489,130.

Two embodiments of the invention will now be described with reference to the accompanying drawings.

Figure 2:
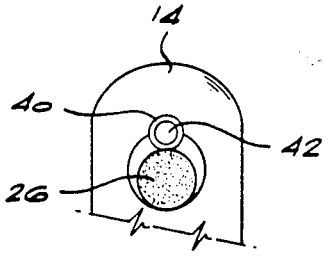
FIG. 2 illustrates an end view of the cutting tool of FIG. 1 in the direction of arrow A.

The first embodiment is illustrated by FIGS. 1 and 2. Referring to these drawings, there is shown a cutting tool for a mining machine of the type used for cutting coal comprising a holding lug 10 made of a suitable hardened steel. The end 12 of the cutting tool is shaped to be received by a slot in the surface of a drum mounted for rotation (not shown), while the other end 14 is provided with a socket 16. The socket 16 is cylindrical in shape and adapted to receive the cylindrical pin 18 of an inert 20. The insert 20 comprises the cylindrical pin 18 made of cemented carbide and a composite abrasive compact 22 bonded to the end 24. The composite abrasive compact 22 comprises an abrasive compact 26 of disc-shape bonded to a cemented carbide backing 28. The cemented carbide backing 28 is bonded to the pin 18 by means of a braze. Methods of brazing the backing 28 to the pin 18 are known in the art.

Formed down one side 30 of the pin 18 is a groove 32 which is half-round in cross-section. This groove 32 aligns with a groove 34 (also half-round in cross-section) formed in the side 36 of the socket 16 when the body is inserted therein. The grooves 32 and 34 together create a circular cavity as can be seen more fully by FIG. 2. A locking body 38 is provided to be inserted in the cavity formed by the aligned grooves 32 and 34. The body 38 comprises an outer sleeve 40 and an inner rod 42. Sleeve 40 may be a roll pin—that is, it may include an outside longitudinally extending through slot to facilitate radial expansion of the sleeve—and rod 42 is adapted to be received by the sleeve 40. Pin 42 is used to expand pin 40 radially outward into a tight, secure engagement with the surfaces of grooves 32 and 34 to hold pin 18 securely in the holding lug 10.

The body 18 is secured to the sides of the socket by means of a non-metallic adhesive of the type described above.

It has been found that the combination of the adhesive and the locking body effectively secures the insert in the socket and prevents any turning or twisting of the insert during use. Moreover, because no heat is required, properties incorporated in the holding lug by prior heat treatment are not destroyed (as tends to occur with brazing) and the braze bond between the backing 28 and pin 18 is not weakened.

Figure 3:
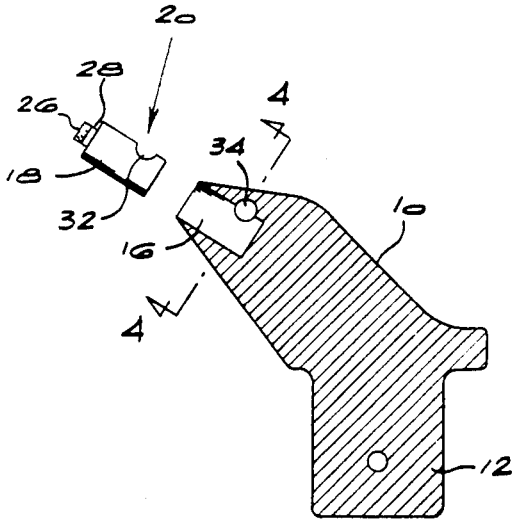
FIG. 3 is a sectional exploded side view of a second embodiment of a cutting tool.
Figure 4:
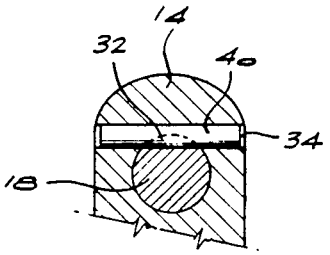
FIG. 4 is a section along the line 4—4 of FIG. 3.

A second embodiment is illustrated by FIGS. 3 and 4. This embodiment is similar to the embodiment of FIGS. 1 and 2 and like parts carry like numerals. This embodiment differs from the embodiment of FIGS. 1 and 2 in that the grooves 32 and 34 are formed transverse to the length of the insert 20 and socket 16.

We claim:

1. A cutting tool for a mining machine, comprising:

a holding lug including a socket, and a first groove a communication with and extending outward from the socket;

a cylindrical pin located in the socket, and including an outside cutting surface, and a second groove aligned with the first groove and extending inward from a side of the pin, said first and second grooves being located opposite each other and forming a locking bore; and means securing the pin in the socket, and including (i) a low temperature non-metallic adhesive or soft solder, applied at a low temperature to the pin and to the surfaces of the lug forming the socket to bond the pin to the lug, and (ii) insert means extending into the locking bore in contact with the holding lug and the pin, to restrain the pin against rotational movement in the socket, the insert means having (a) an axially extending locking sleeve including an axial through bore, and (b) an expansion pin driven into the axial through bore of the locking sleeve, and expanding the sleeve radially outward into a tight pressure engagement with the holding lug and the cylindrical pin.

2. A cutting tool according to claim 1 wherein the cylindrical pin includes an abrasive compact forming said outside cutting surface.

3. A cutting tool according to claim 1 wherein the cylindrical pin has a longitudinal axis, and the locking bore has a longitudinal axis parallel therewith.

4. A cutting tool according to claim 1 wherein the adhesive is an anaerobic adhesive.

5. A cutting tool according to claim 1 wherein the adhesive is a two-part adhesive.

6. A cutting tool according to claim 1 wherein;

the socket has a longitudinal axis;

the locking bore has a longitudinal axis, spaced from and parallel with the longitudinal axis of the socket;

the locking sleeve is coaxial with the locking bore; and the expansion pin is coaxial with the locking sleeve.

7. A cutting tool for a mining machine, comprising:

a holding lug including a socket, and a first groove in communication with and extending outward from the socket;

a cylindrical pin located in the socket, and including an outside cutting surface, and a second groove aligned with the first groove and extending inward from a side of the pin, said first and second grooves being located opposite each other and forming a locking bore; and means securing the pin in the socket, and including (i) a low temperature non-metallic adhesive or soft solder, applied at a low temperature to the pin and to the surfaces of the lug forming the socket to bond the pin to the lug, and (ii) insert means extending into the locking bore, in contact with the holding lug and the pin, to restrain the pin against rotational movement in the socket;

wherein the cylindrical pin has a longitudinal axis, and the locking bore has a longitudinal axis perpendicular thereto.

* * * * *

UNITED STATES PATENT AND TRADEMARK OFFICE

CERTIFICATE OF CORRECTION

PATENT NO. : 4,679,858

DATED : July 14, 1987

INVENTOR(S) : Klaus Tank, et al.

It is certified that error appears in the above-identified patent and that said Letters Patent is hereby corrected as shown below:

On the title page, add --Peter Noel Tomlinson, Mondeor, South Africa-- as a co-inventor

Signed and Sealed this

Fifth Day of April, 1988

*Attest:*

DONALD J. QUIGG

*Attesting Officer*

*Commissioner of Patents and Trademarks*